US010467943B2

(12) United States Patent
Hu et al.

(10) Patent No.: US 10,467,943 B2
(45) Date of Patent: Nov. 5, 2019

(54) APPARATUS AND METHOD FOR COMPENSATING DISPLAY DEFECT OF DISPLAY PANEL

(71) Applicants: BOE TECHNOLOGY GROUP CO., LTD., Beijing (CN); BEIJING BOE DISPLAY TECHNOLOGY CO., LTD., Beijing (CN)

(72) Inventors: Weihao Hu, Beijing (CN); Luqiang Guo, Beijing (CN); Zhiming Meng, Beijing (CN); Jinhui Cheng, Beijing (CN); Chao Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 16 days.

(21) Appl. No.: 15/528,964

(22) PCT Filed: May 26, 2016

(86) PCT No.: PCT/CN2016/083444
§ 371 (c)(1),
(2) Date: May 23, 2017

(87) PCT Pub. No.: WO2017/152506
PCT Pub. Date: Sep. 14, 2017

(65) Prior Publication Data

US 2018/0218662 A1 Aug. 2, 2018

(30) Foreign Application Priority Data

Mar. 8, 2016 (CN) ..... 2016 1 0131557

(51) Int. Cl.
*G09G 3/36* (2006.01)
*G09G 3/20* (2006.01)
*G09G 3/3208* (2016.01)

(52) U.S. Cl.
CPC ..... *G09G 3/2007* (2013.01); *G09G 3/3208* (2013.01); *G09G 3/36* (2013.01);
(Continued)

(58) Field of Classification Search
CPC .. G09G 3/2007; G09G 3/3208; G09G 3/3685; G09G 3/3607; G09G 2320/041; G09G 2320/0233; G09G 2310/027
See application file for complete search history.

(56) References Cited

U.S. PATENT DOCUMENTS

2006/0012606 A1 1/2006 Hiraki et al.
2008/0224981 A1 9/2008 Shen et al.
(Continued)

FOREIGN PATENT DOCUMENTS

CN 1694153 A 11/2005
CN 1722211 A 1/2006
(Continued)

OTHER PUBLICATIONS

Office Action in Chinese Application No. 201610131557.8 dated Sep. 1, 2017, with English translation.
(Continued)

*Primary Examiner* — Amit Chatly
(74) *Attorney, Agent, or Firm* — Womble Bond Dickinson (US) LLP

(57) ABSTRACT

An apparatus for compensating a display defect of a display panel is disclosed. The apparatus includes: a first interface for receiving a display drive signal to be applied to the display panel, the display drive signal including display data for respective pixels of the display panel; a second interface
(Continued)

for receiving a temperature signal associated with the display panel; a compensation unit configured to compensate display data for a pixel at a position of the display defect based at least on the temperature signal; and a third interface for outputting the compensated display data. Also disclosed is a method of compensating a display defect of a display panel.

4 Claims, 5 Drawing Sheets

(52) U.S. Cl.
CPC ..... *G09G 3/3607* (2013.01); *G09G 3/3685* (2013.01); *G09G 2310/027* (2013.01); *G09G 2320/0233* (2013.01); *G09G 2320/041* (2013.01); *G09G 2330/10* (2013.01)

(56) References Cited

U.S. PATENT DOCUMENTS

| | | | | |
|---|---|---|---|---|
| 2009/0256791 | A1 | 10/2009 | Wang | |
| 2012/0075362 | A1* | 3/2012 | Ichioka | G09G 3/3426 345/690 |
| 2012/0139955 | A1 | 6/2012 | Jaffari et al. | |
| 2013/0321361 | A1* | 12/2013 | Lynch | G09G 3/3225 345/204 |
| 2014/0104259 | A1 | 4/2014 | Oh et al. | |
| 2015/0356896 | A1 | 12/2015 | Kao et al. | |
| 2016/0071487 | A1 | 3/2016 | Lu et al. | |
| 2017/0243562 | A1 | 8/2017 | Hu et al. | |

FOREIGN PATENT DOCUMENTS

| | | | |
|---|---|---|---|
| CN | 101266764 | A | 9/2008 |
| CN | 101556777 | A | 10/2009 |
| CN | 102486912 | A | 6/2012 |
| CN | 103021363 | A | 4/2013 |
| CN | 104299563 | A | 1/2015 |
| CN | 104992657 | A | 10/2015 |
| JP | 2002023702 | A | 1/2002 |
| KR | 1020140047836 | | 4/2014 |

OTHER PUBLICATIONS

International Search Report and Written Opinion in PCT/CN2016/083444 dated Dec. 14, 2016, with English translation.

Office Action received for Chinese Patent Application No. 201610131557.8, dated Feb. 11, 2018, 22 pages (19 pages of English Translation and 14 pages of Office Action).

* cited by examiner

APPARATUS AND METHOD FOR COMPENSATING DISPLAY DEFECT OF DISPLAY PANEL

CROSS-REFERENCE TO RELATED APPLICATIONS

The present application is the U.S. national phase entry of PCT/CN2016/083444, with an international filing date of May 26, 2016, which claims the benefit of Chinese Patent Application No. 201610131557.8, filed on Mar. 8, 2016, the entire disclosures of which are incorporated herein by reference.

TECHNICAL FIELD

The present disclosure relates to the field of display technologies, and particularly to an apparatus and method for compensating a display defect of a display panel. The present disclosure further relates to a display device including the apparatus.

BACKGROUND

In a typical active matrix display, each pixel has a thin film transistor (TFT) with a gate electrode thereof being connected to a gate line in a horizontal direction and a source electrode thereof being connected to a data line in a vertical direction. When a gate scan pulse is applied to a gate line, a row of TFTs connected to this gate line is turned on, such that grayscale voltages on respective data lines are written to the row of pixels.

Due to manufacturing process, defect areas (or "mura") where luminance is significantly different than other areas at the same grayscale voltage tend to be formed on the display panel. FIG. 1 is a schematic view showing a display panel 100 on which several defect areas are present. With the same grayscale voltage being applied to respective pixels of the display panel, there are still some positions where the luminance is darker. As shown in FIG. 1, the luminance of a central area 110 is significantly lower than the remaining areas. Such a display defect is undesirable.

SUMMARY

Embodiments of the present disclosure provide an apparatus and method for compensating a display defect of a display panel, which seek to improve the compensating of the display defect of the display panel by taking into account a temperature factor.

According to an aspect of the present disclosure, an apparatus is provided for compensating a display defect of a display panel. The apparatus comprises a first interface for receiving a display drive signal to be applied to the display panel. The display drive signal comprises display data for respective pixels of the display panel. The apparatus further comprises a second interface for receiving a temperature signal associated with the display panel; a compensation unit configured to compensate display data for a pixel at a position of the display defect based at least on the temperature signal; and a third interface for outputting the compensated display data.

In some embodiments, the compensation unit is configured to compensate the display data for the pixel at the position of the display defect based on a reference compensation coefficient and the temperature signal. The reference compensation coefficient is a compensation coefficient for the pixel at a reference temperature.

In some embodiments, the compensation unit comprises: a memory configured to store the reference compensation coefficient and positional information indicative of the position of the display defect; a correction coefficient generation module configured to determine temperature correction coefficients for the respective pixels of the display panel based on the temperature signal; compensation coefficient correction module configured to correct the reference compensation coefficient with a corresponding one of the temperature correction coefficients based on the positional information; and a compensation execution module configured to mix the display data for the pixel at the position of the display defect and the corrected reference compensation coefficient based on the positional information and the display drive signal.

In some embodiments, the compensation coefficient correction module is configured to perform an operation between the corresponding temperature correction coefficient and the reference compensation coefficient, and the operation is selected from the group consisting of multiplication and addition.

In some embodiments, the compensation execution module is configured to perform an operation between the display data and the corrected reference compensation coefficient, and the operation is selected from the group consisting of multiplication and addition.

In some embodiments, the temperature signal is measured at a predetermined position in the display panel. The correction coefficient generation module is configured to determine temperatures at the respective pixels of the display panel from the temperature signal according to a temperature distribution determined in advance, and to determine the temperature correction coefficients for the respective pixels from the temperatures.

In some embodiments, the display panel is a liquid crystal display panel, and the predetermined position is a position where a backlight strip of the liquid crystal display panel is located.

In some embodiments, the compensation unit comprises: a memory configured to store the reference compensation coefficient and positional information indicative of the position of the display defect; a first compensation execution module configured to mix the display data for the pixel at the position of the display defect and the reference compensation coefficient based on the positional information and the display drive signal; a correction coefficient generation module configured to determine temperature correction coefficients for the respective pixels of the display panel based on the temperature signal; and a second compensation execution module configured to, based on the positional information, mix the display data for the pixel at the position of the display defect that has been mixed by the first compensation execution module and a corresponding one of the temperature correction coefficients.

According to another aspect of the present disclosure, a display device is provided comprising: a display panel; the apparatus as described above; and a data driver configured to receive and convert the compensated display data into corresponding grayscale voltages, and to apply the grayscale voltages to the display panel.

In some embodiments, the display panel is selected from the group consisting of a liquid crystal display panel and an organic light-emitting diode display panel.

According to yet another aspect of the present disclosure, a method of compensating a display defect of a display panel is provided which comprises: receiving a display drive signal to be applied to the display panel and a temperature signal associated with the display panel, the display drive signal comprising display data for respective pixels of the display panel; and compensating display data for a pixel at a position of the display defect based at least on the temperature signal.

In some embodiments, the compensating of the display data comprises compensating the display data for the pixel at the position of the display defect based on a reference compensation coefficient and the temperature signal. The reference compensation coefficient is a compensation coefficient for the pixel at a reference temperature.

In some embodiments, the compensating of the display data based on the reference compensation coefficient and the temperature signal comprises: determining temperature correction coefficients for the respective pixels of the display panel based on the temperature signal; correcting the reference compensation coefficient with a corresponding one of the temperature correction coefficients based on the positional information; and mixing the display data for the pixel at the position of the display defect and the corrected reference compensation coefficient based on the positional information and the display drive signal.

In some embodiments, the generating of the correction compensation coefficient comprises performing an operation between the temperature correction coefficient and the reference compensation coefficient, and the operation selected is from the group consisting of multiplication and addition.

In some embodiments, the mixing comprises performing an operation between the display data and the correction compensation coefficient, and the operation is selected from the group consisting of multiplication and addition.

In some embodiments, the determining of the temperature correction coefficients comprises: measuring the temperature signal at a predetermined position of the display panel; determining temperatures at the respective pixels of the display panel from the temperature signal according to a temperature distribution determined in advance; and determining the temperature correction coefficients for the respective pixels from the temperatures.

In some embodiments, the display panel is a liquid crystal display panel, and the predetermined position is a position where a backlight strip of the liquid crystal display panel is located.

In some embodiments, the compensating of the display data based on the reference compensation coefficient and the temperature signal comprises: mixing the display data for the pixel at the position of the display defect and the reference compensation coefficient based on the positional information and the display drive signal; determining temperature correction coefficients for the respective pixels of the display panel based on the temperature signal; and mixing, based on the positional information, the reference compensation coefficient mixed display data for the pixel at the position of the display defect and a corresponding one of the temperature correction coefficients.

These and other aspects of the present disclosure will be apparent from and elucidated with reference to the embodiment(s) described hereinafter.

BRIEF DESCRIPTION OF THE DRAWINGS

Further details, features and advantages of the disclosure are disclosed in the following description of exemplary embodiments in connection with the accompanying drawings, in which.

DETAILED DESCRIPTION

The disclosure will now be described more fully hereinafter with reference to the accompanying drawings, in which exemplary embodiments of the disclosure are shown. The present disclosure may, however, be embodied in many different forms and should not be construed as being limited to the embodiments set forth herein. The embodiments described are intended to fully convey the scope of the disclosure to those skilled in the art.

Figure 2A:
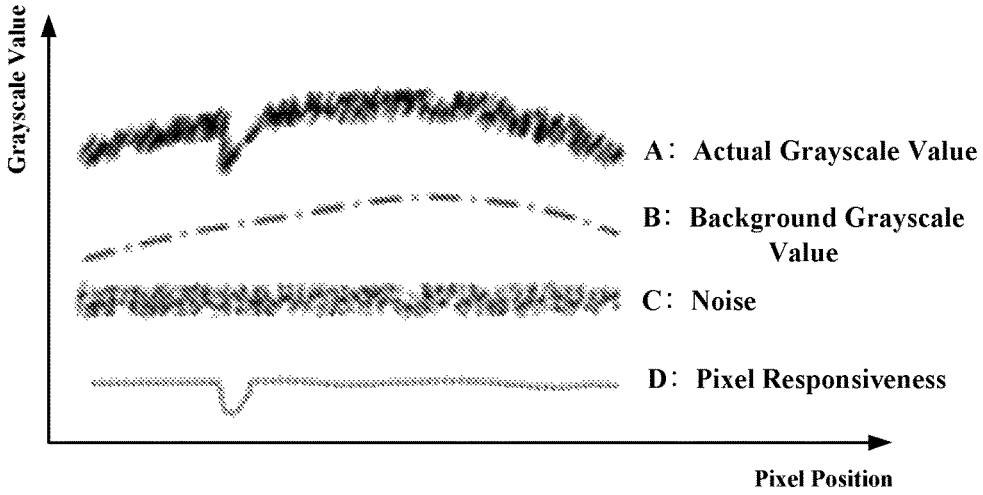
FIG. 2A is a graph showing grayscale values for a row or column of pixels of a display panel.

FIG. 2A is a graph showing grayscale values for a row or column of pixels of a display panel, wherein the ordinate denotes grayscale values for pixels, and the abscissa denotes positions of the pixels. Curve A represents actual grayscale values for respective pixels, curve B represents background grayscale values for the respective pixels (which correspond to theoretical grayscale voltage levels that are converted from display data for the respective pixels), and curve C represents noise components for the respective pixels. Curve D is derived when the background grayscale value curve B and the noise component curve C are deducted from the actual grayscale value curve A, which curve D represents the responsiveness of the respective pixels at the same level of grayscale voltage.

Figure 1:
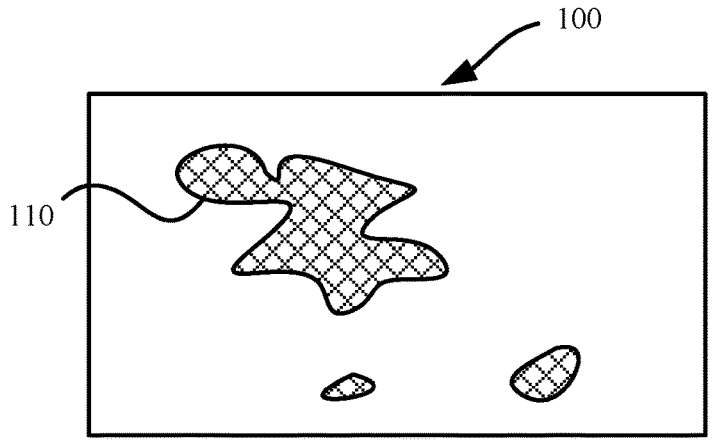
FIG. 1 is a schematic view showing a display panel on which several defect areas are present.

As shown in FIG. 2A, there is a recess in the left portion of curve D, indicating that the pixels at the positions of the recess have lower responsiveness at the same level of grayscale voltage thereby resulting in a display defect. If the recess as shown in FIG. 2A extends to a number of successive rows or columns, the defect areas as shown in FIG. 1 may be created.

It is known that non-uniformity of luminance may be eliminated by compensating the display data for the pixel at the display defect (referred to hereinafter as "defect pixel") as shown in e.g. FIG. 2A. Specifically, for the defect pixel, the display data may be multiplied by a compensation coefficient and then provided to a data driver, by which the compensated display data is converted into a grayscale voltage that is to be applied to the defect pixel. Alternatively, the display data may be superimposed by a positive or negative compensation coefficient. The compensation coefficient is selected such that the defect pixel has substantially the same luminance as the normal pixels for the same original display data. Thereby, the display defect may be visually unobservable.

Figure 2B:
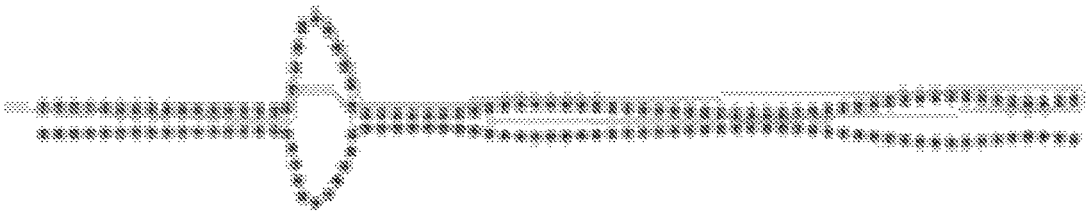
FIG. 2B shows a principle of compensating the display defect in FIG. 2A.

FIG. 2B shows a principle of compensating the display defect in FIG. 2A. In FIG. 2B, the lower curve represents the responsiveness of the pixels, and the upper curve represents a level of compensation of the pixels, both of which being in mirror symmetry. When they are superimposed with each other, a responsiveness curve will be obtained that is substantially horizontal. It is to be noted that although the defect pixels shown in FIGS. 2A and 2B has lower responsiveness, the principle of compensation shown in FIG. 2B is also applicable to pixels having higher responsiveness (in which case curve D shown in FIG. 2A will be provided with a protrusion portion).

The Inventors have recognized after an in-depth study that the temperature is a sensitive parameter for the responsiveness of the pixels. That is, curve D shown in FIG. 2A only reflects the responsiveness of the pixels at a specific temperature. In general, as the temperature decreases, the display defect of the display panel will be intensified. Thus, the compensation effect may not be satisfying if the same level of compensation is used at different temperatures.

The Inventors have also recognized that the distribution of temperature on the display panel has regularity. For example, for a liquid crystal panel having a backlight, when backlight strips are disposed at both ends of the liquid crystal panel, the area of the panel close to the strips has the highest temperature, and the temperature gradually decreases in a direction toward a middle area of the panel. For the liquid crystal panel of the same structure and manufacturing process, there is a fixed regularity for the distribution of temperature on the panel. Such fixed distribution regularity may be measured in advance such that the distribution of temperature throughout the liquid crystal panel can be derived by measuring the temperature at a specific position (e.g., at a position where the backlight strip is located), thereby determining the temperatures at respective pixels. For an organic light-emitting diode (OLED) display panel having self-luminous pixels, there is no significant difference in temperature between different areas of the panel. Thus, the OLED panel may be considered as having a uniform distribution of temperature.

Based on the above recognitions, a mechanism is proposed where the display defect of the display panel is compensated by taking into account the temperature factor.

Figure 3:
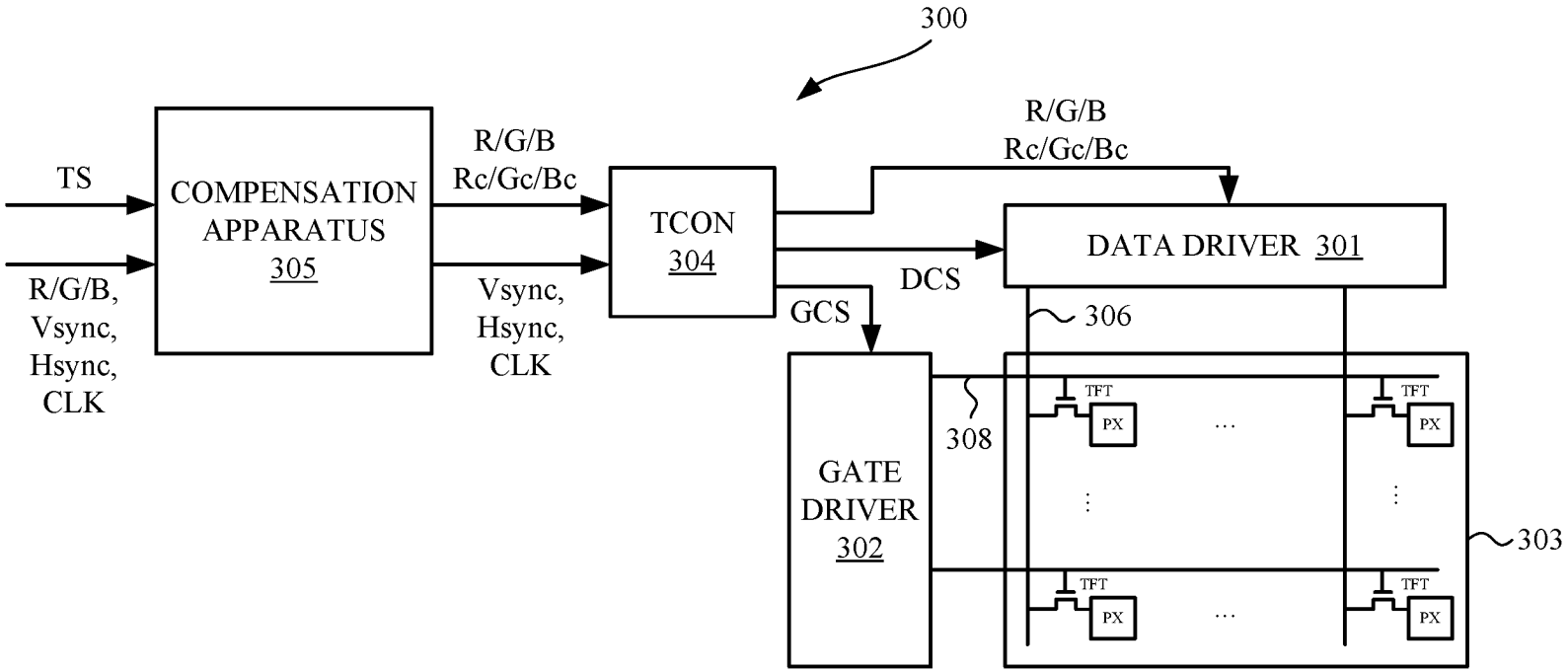
FIG. 3 is block diagram showing a display device according to an embodiment of the present disclosure.

FIG. 3 is block diagram showing a display device 300 according to an embodiment of the present disclosure.

Referring to FIG. 3, the display device 300 comprises a display panel 303 on which data lines 306 and gate lines 308 intersect with each other and thin film transistors (TFTs) for driving pixel units PX are formed at the intersections. In this example, the display panel 303 is shown as an active matrix (AM) display panel, and may be one of a liquid crystal display panel and an organic light-emitting diode display panel. In other embodiments, the display panel 303 may also be a display panel of any other type.

The display device 300 further comprises a compensation apparatus 305 for compensating display data R/G/B for a pixel at a position of a display defect, a data driver 301 for supplying the compensated display data Rc/Gc/Bc to the data lines 306, a gate driver 302 for supplying gate scan pulses sequentially to gate lines 308, and a timing controller (TCON) 304 for control of the drivers 301 and 302.

The compensation apparatus 305 receives the display data R/G/B from a system interface, and a temperature signal TS associated with the display panel 303 from a temperature sensor (not shown) disposed at a predetermined position on the display panel 303. Further, the compensation apparatus 305 compensates the display data R/G/B for the pixel at the position of the display defect based on the temperature signal TS, and outputs the compensated display data Rc/Gc/Bc as well as the uncompensated data R/G/B for normal pixels.

In synchronization with a clock signal CLK, TCON 304 supplies the display data Rc/Gc/Bc and R/G/B to the data driver 301, and generates a gate control signal GCS for controlling the gate driver 302 and a data control signal DCS for controlling the data driver 301 with a vertical and horizontal sync signal Vsync and Hsync. In some embodiments, the compensation apparatus 305 and TCON 304 may be integrated into a single chip.

The data driver 301 converts the display data Rc/Gc/Bc and R/G/B into analog grayscale voltages and supplies the analog grayscale voltages to the data lines 306.

The gate driver 302 supplies the gate scan pulses sequentially to the gate lines 308 for selection of a gate line to be supplied with the analog grayscale voltages.

Figure 4:
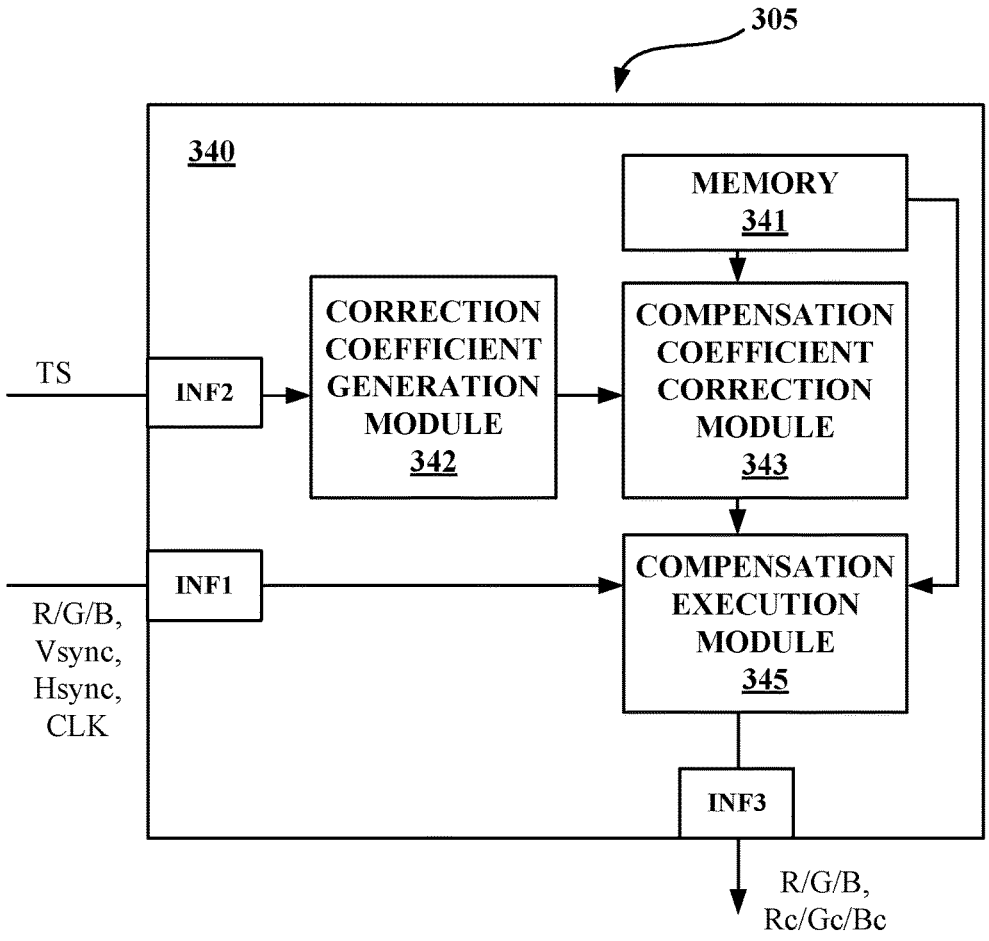
FIG. 4 is a block diagram showing an embodiment of the compensation apparatus of FIG. 3.

FIG. 4 is a block diagram showing an embodiment of the compensation apparatus 305 of FIG. 3.

The apparatus 305 comprises a first interface INF1, a second interface INF2, a third interface INF3 and a compensation unit 340, wherein the compensation unit 340 is coupled to the first interface INF1, the second interface INF2 and the third interface INF3.

The first interface INF1 receives a display drive signal to be applied to the display panel 303. In the example of FIG. 4, the display drive signal includes display data R/G/B for respective pixels of the display panel 303, a vertical sync signal Vsync, a horizontal sync signal Hsync, and a clock signal CLK. It will be understood therefore that the first interface INF1 may have a plurality of separate data channels for receipt of different signal components. The second interface INF2 receives a temperature signal TS associated with the display panel 303.

The compensation unit 340 is configured to compensate display data R/G/B for a pixel at a position of the display defect based at least on the temperature signal TS. The third interface INF3 outputs the compensated display data Rc/Gc/Bc. The third interface INF3 may also output the uncompensated data R/G/B for normal pixels.

Specifically, the compensation unit 340 is configured to compensate the display data R/G/B for the pixel at the position of the display defect based on a reference compensation coefficient and the temperature signal TS. The reference compensation coefficient refers herein to a compensation coefficient for compensating the display data for the defect pixel at a reference temperature.

As shown in FIG. 4, the compensation unit 340 comprises a memory 341, a correction coefficient generation module 342, a compensation coefficient correction module 343 and a compensation execution module 345.

The memory 341 stores the reference compensation coefficient for the defect pixel. The memory 341 also stores positional information indicative of the position of the defect pixel. The positional information may, for example, be a row number and a column number for the defect pixel in the pixel array of the display panel. For a specific display panel, the positional information indicative of the position of its defect pixel and the reference compensation coefficient for the defect pixel may be pre-programmed in the memory 341.

The correction coefficient generation module 342 is configured to determine temperature correction coefficients for the respective pixels of the display panel 303 based on the temperature signal TS associated with the display panel 303.

The temperature signal associated with the display panel herein is to be interpreted in a broad sense. As described above, in some embodiments, the temperature signal may be one measured at the position of the backlight strip in the liquid crystal panel. In other embodiments, the temperature signal may be one measured at other positions in the liquid crystal panel. In a word, the temperature signal associated with the display panel refers to a signal from which the temperatures at the respective pixels can be determined directly or indirectly.

The correction coefficient generation module 342 determines the temperatures at the respective pixels from the temperature signal TS according to the distribution regularity of temperature on the display panel, and derives from the determined temperatures the temperature correction coefficients for correcting the reference compensation coefficient. As described above, as the temperature decreases, the display defect of the display panel will be intensified. Thus, where the temperature at the defect pixel is below the reference temperature, the temperature correction coefficient may be selected such that the reference compensation coefficient is increased. In contrary, where the temperature at the defect pixel is above the reference temperature, the temperature correction coefficient may be selected such that the reference compensation coefficient is decreased.

The compensation coefficient correction module 343 is configured to correct the reference compensation coefficient with the temperature correction coefficient corresponding to the defect pixel based on the positional information of the defect pixel. In some embodiments, the corrected compensation coefficient may be obtained by multiplying the reference compensation coefficient with the temperature correction coefficient. Alternatively, the corrected compensation coefficient may be obtained by adding the reference compensation coefficient with the corresponding temperature correction coefficient.

The compensation execution module 345 is configured to mix the display data R/G/B for the pixel at the position of the display defect and the corrected reference compensation coefficient based on the positional information and the display drive signal. Specifically, the compensation execution module 345 determines, from the vertical sync signal Vsync, the horizontal sync signal Hsync and the clock signal CLK, a display position for the display data R/G/B from the first interface INF1, compares the determined display position to the positional information indicative of the position of the defect pixel that comes from the memory 341, and detects the display data R/G/B for the defect pixel. The compensation execution module 345 further mixes the display data R/G/B for the defect pixel and the corrected reference compensation coefficient from the compensation coefficient correction module 343. Depending on the algorithm applied, the mixing may be based on a multiplication operation or an addition operation.

The compensated display data Rc/Gc/Bc for the defect pixel and the uncompensated display data R/G/B for the normal pixels are output via the third interface INF3.

Since the temperature factor has been taken into consideration in the compensation, improved compensation effect may be achieved. Additionally, as the determination of the temperatures of the respective pixels requires only the temperature measurements at several positions, the need for arrangement of a great number of temperature sensors is eliminated. This is advantageous for reduction in cost.

Figure 5:
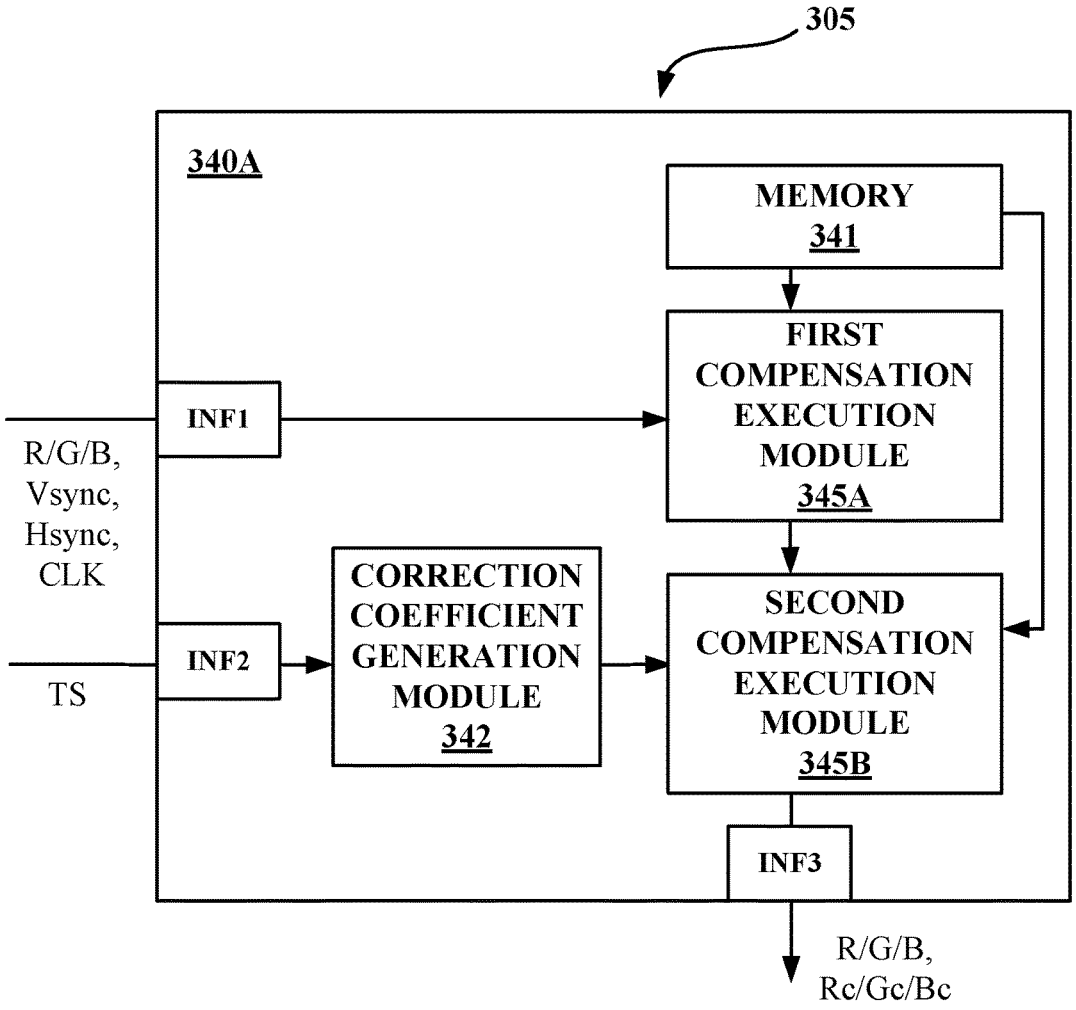
FIG. 5 is a block diagram showing another embodiment of the compensation apparatus of FIG. 3.

FIG. 5 is a block diagram showing another embodiment of the compensation apparatus 305 of FIG. 3.

In this embodiment, the apparatus 305 comprises a first interface INF1, a second interface INF2, a third interface INF3 and a compensation unit 340A, wherein the compensation unit 340A is coupled to the first interface INF1, the second interface INF2 and the third interface INF3.

Referring to FIG. 5, the compensation unit 340A comprises a memory 341, a correction coefficient generation module 342, a first compensation execution module 345A, and a second compensation execution module 345B.

Similar to the embodiment of FIG. 4, the memory 341 stores the reference compensation coefficient for the defect pixel and the positional information indicative of the position of the defect pixel, and the correction coefficient generation module 342 is configured to determine temperature correction coefficients for the respective pixels of the display panel 303 based on the temperature signal TS associated with the display panel 303.

The first compensation execution module 345A is configured to mix the display data R/G/B for the defect pixel and the reference compensation coefficient based on the display drive signal and the positional information indicative of the position of the defect pixel. Specifically, the first compensation execution module 345A determines, from the vertical sync signal Vsync, the horizontal sync signal Hsync and the clock signal CLK, a display position for the display data R/G/B from the first interface INF1, compares the determined display position to the positional information indicative of the position of the defect pixel that comes from the memory 341, and detects the display data R/G/B for the defect pixel. The first compensation execution module 345A further mixes the display data R/G/B for the defect pixel and the reference compensation coefficient from the memory 341.

The second compensation execution module 345B is configured to, based on the positional information from the memory 341, mix the display data R/G/B that has been mixed by the first compensation execution module 345A and a corresponding temperature correction coefficient from the correction coefficient generation module 342.

The compensated display data Rc/Gc/Bc for the defect pixel and the uncompensated display data R/G/B for the normal pixels are output via the third interface INF3.

Similar to the above embodiments, the mixing by the first and second compensation execution modules 345A and 345B may be based on a multiplication operation or an addition operation. It is to be noted that the orders in which the first and second compensation execution modules 345A and 345B perform the mixing may be interchangeable. That is, it may be possible to mix the display data R/G/B first with the temperature correction coefficient, and then with the reference compensation coefficient.

Figure 6:
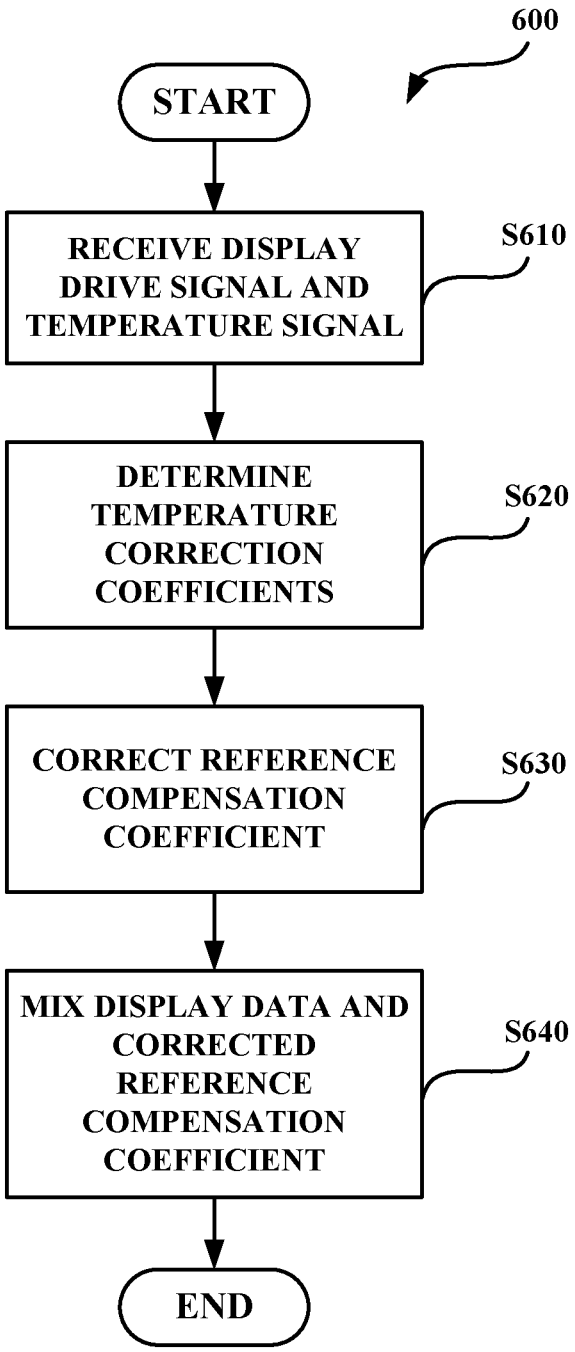
FIG. 6 is a flow chart of a method for compensating a display defect of a display panel according to an embodiment of the present disclosure.

FIG. 6 is a flow chart of a method 600 for compensating a display defect of a display panel according to an embodiment of the present disclosure. The method 600 may be implemented with the compensation apparatus 305 as shown in FIG. 4 or FIG. 5, although the present disclosure is not limited thereto.

In step S610, a display drive signal to be applied to the display panel is received from a system interface, and a temperature signal associated with the display panel is received from e.g. a temperature sensor.

Then, display data for a pixel at a position of the display defect is compensated based at least on the temperature signal. In step S620, temperature correction coefficients for the respective pixels of the display panel are determined based on the temperature signal. In step S630, the reference compensation coefficient is corrected with a corresponding one of the temperature correction coefficients based on the positional information. In step S640, the display data for the pixel at the position of the display defect is mixed with the corrected reference compensation coefficient based on the positional information and the display drive signal.

Implementation of the above steps S620 to S640 has been illustrated in the embodiments described above with respect to FIGS. 3 to 5, and thus is not repeated here for brevity.

Variations to the disclosed embodiments can be understood and effected by the skilled person in practicing the claimed subject matter, from a study of the drawings, the disclosure, and the appended claims. In the claims, the word "comprises" or "comprising" does not exclude other elements or steps, and the indefinite article "a" or "an" does not exclude a plurality. The mere fact that certain measures are recited in mutually different dependent claims does not indicate that a combination of these measures cannot be used to advantage.

What is claimed is:

1. An apparatus for compensating a display defect of a display panel, comprising:

a first interface for receiving a display drive signal to be applied to the display panel, the display drive signal comprising display data for respective pixels of the display panel, the pixels comprising a pixel at a position of the display defect and normal pixels;

a second interface for receiving a temperature signal associated with the display panel;

a compensation unit configured to compensate the display data for the pixel at the position of the display defect based on a reference compensation coefficient and the temperature signal, without compensating the display data for the normal pixels, the compensation unit comprising a memory configured to store the reference compensation coefficient and positional information indicative of the position of the display defect, wherein the reference compensation coefficient is a compensation coefficient for the pixel at the position of the display defect at a reference temperature; and a third interface for outputting the compensated display data for the pixel at the position of the display defect and the uncompensated display data for the normal pixels, wherein the compensation unit further comprises:

a first compensation execution module configured to mix the display data for the pixel at the position of the display defect and the reference compensation coefficient based on the positional information and the display drive signal;

a correction coefficient generation module configured to determine temperature correction coefficients for the respective pixels of the display panel based on the temperature signal; and a second compensation execution module configured to, based on the positional information, mix the display data for the pixel at the position of the display defect that has been mixed by the first compensation execution module and a corresponding one of the temperature correction coefficients.

2. A display device comprising:

the display panel for use with the apparatus of claim 1;

the apparatus of claim 1; and a data driver configured to receive and convert the compensated display data and the uncompensated display data into corresponding grayscale voltages, and to apply the grayscale voltages to the display panel.

3. The display device of claim 2, wherein the display panel is selected from the group consisting of a liquid crystal display panel and an organic light-emitting diode display panel.

4. A method of compensating a display defect of a display panel, comprising:

receiving a display drive signal to be applied to the display panel and a temperature signal associated with the display panel, the display drive signal comprising display data for respective pixels of the display panel, the pixels comprising a pixel at a position of the display defect and normal pixels;

compensating the display data for the pixel at the position of the display defect based on a reference compensation coefficient and the temperature signal, without compensating the display data for the normal pixels, wherein the reference compensation coefficient is a compensation coefficient for the pixel at the position of the display defect at a reference temperature; and outputting the compensated display data for the pixel at the position of the display defect and the uncompensated display data for the normal pixels, wherein the compensating of the display data based on the reference compensation coefficient and the temperature signal comprises:

mixing the display data for the pixel at the position of the display defect and the reference compensation coefficient based on the positional information and the display drive signal;

determining temperature correction coefficients for the respective pixels of the display panel based on the temperature signal; and mixing, based on the positional information, the reference compensation coefficient mixed display data for the pixel at the position of the display detect and a corresponding one of the temperature correction coefficients.

* * * * *